US006772894B1

(12) United States Patent
Druitt et al.

(10) Patent No.: US 6,772,894 B1
(45) Date of Patent: Aug. 10, 2004

(54) CLOSURE WITH SEAL MEMBER

(75) Inventors: Rodney Malcolm Druitt, Warwickshire (GB); David Foster, Peterborough (GB); Reginald Denny, Worcestershire (GB)

(73) Assignee: Closures and Packaging Services Limited, Guernsey (GB)

( * ) Notice: Subject to any disclaimer, the term of this patent is extended or adjusted under 35 U.S.C. 154(b) by 0 days.

(21) Appl. No.: 09/936,817

(22) PCT Filed: Mar. 20, 2000

(86) PCT No.: PCT/AU00/00218

§ 371 (c)(1),
(2), (4) Date: Feb. 20, 2002

(87) PCT Pub. No.: WO00/56616

PCT Pub. Date: Sep. 28, 2000

(30) Foreign Application Priority Data

Mar. 18, 1999 (GB) ..... 9906194

(51) Int. Cl.[7] ..... B65D 53/00
(52) U.S. Cl. ..... 215/394; 215/252; 215/DIG. 1
(58) Field of Search ..... 215/344, 352, 215/DIG. 1, 343, 341, 345, 44, 45, 331, 256, 252, 340; 220/304, 795

(56) References Cited

U.S. PATENT DOCUMENTS

| | | | | |
|---|---|---|---|---|
| 3,151,757 A | * | 10/1964 | Martin | 215/260 |
| 3,203,571 A | * | 8/1965 | Plunkett | 215/344 |
| 4,209,102 A | | 6/1980 | Dunn et al. | |
| 4,598,835 A | * | 7/1986 | Brownbill | 215/307 |
| 5,423,444 A | | 6/1995 | Druitt | |
| 5,609,263 A | | 3/1997 | Perchepied | |
| 5,676,269 A | | 10/1997 | Blake et al. | |
| 5,782,369 A | | 7/1998 | Tansey | |

FOREIGN PATENT DOCUMENTS

| | | | | |
|---|---|---|---|---|
| AU | 45484/93 | | 7/1993 | |
| AU | 52116/96 | | 4/1996 | |
| AU | 199880944 | | 7/1998 | |
| EP | 136088 A2 | | 4/1985 | |
| EP | 508668 A1 | | 10/1992 | |
| GB | 2120219 A | | 9/1983 | |
| GB | 2109778 A | | 6/1993 | |
| WO | WO 99/03746 | * | 1/1999 | 215/344 |

* cited by examiner

*Primary Examiner*—Lien Ngo
(74) *Attorney, Agent, or Firm*—McDermott, Will & Emery LLP

(57) ABSTRACT

A closure (10) for mounting onto a container (16), the closure (10) including a top portion (11) and a skirt portion (12) depending from the top portion (11). An annular sealing rib (20) projects downwardly from an underside of the top portion (11). The rib (20) includes a first portion (14) which is contiguous with the top portion (11) and has an inner surface (19) which lies radially inwardly of the skirt portion (12) and at least a second, frusto-conical, portion (15) contiguous with the first portion (14) and separated from the top portion (11) by the inner surface (19) of the first portion (14). The second portion (15) has an upper side and an underside and extends radially inwardly to a circular edge. The inner surface (19) of the first portion (14) has an internal diameter relative to the external diameter of the end portion (30) of the container (16) to which the closure is to be attached such that during attachment of the closure with the end portion of the container, the sealing rib (20) is engaged by the end portion of the container so folding the second portion (15) at least towards the inner surface (19) of the first portion (14) of the rib to form a seal between at least an outer surface of the end portion of the container and the closure. The closure further has an annular protrusion (22) formed on the underside of the second portion (15) which extends outwardly therefrom. The protrusion (22), on attachment of the closure with the end portion, engages the outer surface of the end portion (30) so causing the sealing rib (20) to be disposed over a greater area of the outer surface of the end portion of the container.

23 Claims, 3 Drawing Sheets

CLOSURE WITH SEAL MEMBER

TECHNICAL FIELD

The present invention relates to linerless closures for containers. More particularly, the invention relates to such closures for use in hot fill and aseptic processes.

BACKGROUND ART

Refrigeration or preservatives are two techniques that have long been used for ensuring that foods and beverages remain suitable for consumption by consumers. Canning, where products are heated in the container over a period of time, has also long been used as a means of sterilising food products.

Hot fill and aseptic processing are two more recent techniques developed for sterilising foods and beverages. Hot fill processing is used in the packaging of beverages such as iced tea, water and fruit juice. Aseptic processing is also used in the packaging of these products and other foods including milk, soups, yoghurts and tomato products.

In the hot fill process, the containers are filled with the beverage while the beverage is still hot. This process serves to sterilise the beverage before sealing of the container. Beverages packed in this way can be shipped without the need to provide refrigeration of the containers.

Due to the temperatures involved, the hot fill process results in an expansion of the container and closure subsequent to the filling and sealing of the container. The subsequent cooling of the container typically extends over a considerable period and creates a partial vacuum inside the container due to contraction of the beverage and of the air in the void above the beverage.

Closures for sealing containers filled using the hot fill process must be able to withstand the high temperatures of the filling process and remain sealed to the container during cooling of the container after filling. Closures for hot fill application usually comprise a polypropylene cap having a top and depending skirt, with a wad or liner positioned within the cap and fixed to the underside of the top.

Linerless closures have also been proposed for use in hot fill applications. Typically, such linerless closures rely on a bore seal that extends into the bore of the end portion of the container and seals with the inside surface of the end portion of the container. By having a bore seal that extends well down the inside surface of the end portion of the container, the prospect of loss of seal due to differential shrinkage of the closure and the container during the hot fill process is minimised.

In aseptic packaging, the container is sterilised and filled with a sterile food product within the confines of a hygienic environment. The liquid food or beverage is sterilised outside the container using an ultra-high temperature process that rapidly heats, then cools the product before filling the container. Any packaging used in the aseptic process must be able to preserve the sterilisation of the package's contents until the package is opened by the end consumer. One form of aseptic packaging container presently used is a box-shaped package that is a laminate of paperboard, polyethylene and aluminium.

Certain linerless closures have been proposed for use in sealing containers for carbonated beverages. U.S. Pat. No. 5,423,444 discloses a plastic closure for a container having an externally screw threaded neck, the closure including a top portion and an internally threaded skirt. The closure has an annular sealing rib which projects downwardly from the underside of the top portion. The rib includes a first substantially cylindrical portion contiguous with the underside of the top portion and lying adjacent to or abutting with the skirt, and a second, frusto-conical, portion contiguous with the end of the first portion distal to the underside of the top portion and extending radially inwardly to a circular free edge. During threaded attachment of the closure with the neck, the second, frusto-conical, portion will be engaged by a free end of the neck and folded back towards the first, substantially cylindrical portion of the rib to form a gas tight seal between at least the outer surface of the neck of the container and the closure.

U.S. Pat. No. 5,609,263 discloses a variant of the above closure in which there is at the free end of the second portion of the rib a thick seal ring of substantially circular cross-sectional shape. The rib and the seal ring are dimensioned to engage the free end of the neck when the closure is threaded onto the neck such that when the neck is fully screwed into the closure its free end crushes the seal ring directly against the inside surface of the top portion of the closure.

Australian Patent Application No 80944/98 discloses still further variants of the closure described in U.S. Pat. No. 5,423,444. In one variant, the sealing rib of the closure has a third portion connected to the second portion at or adjacent its circular edge and extending generally in a direction away from the top portion. The third portion is substantially no thicker than the second portion and has a length longer than its thickness. On attachment of this closure to a container, the third portion is positioned between the neck of the container and the underside of the top portion of the closure.

The present invention is directed to a sealing rib arrangement for closures that further improves the sealing ability of linerless closures of the type identified in the abovementioned prior art particularly when used in the hot fill process.

DISCLOSURE OF THE INVENTION

According to a first aspect, the present invention relates to a closure suitable for mounting onto a container, the container having an opening defined by an end portion of the container, the closure including a top portion and a skirt portion depending from the top portion, an annular sealing rib projecting downwardly from an underside of the top portion, the rib including a first portion which is contiguous with the top portion and having an inner surface, which inner surface lies radially inwardly of the skirt portion and at least a second, frusto-conical, portion contiguous with the first portion and separated from the top portion by the inner surface of the first portion, the second portion having an upper side and an underside and extending radially inwardly to a circular edge, the inner surface of the first portion having an internal diameter relative to the external diameter of the end portion of the container to which the closure is to be attached such that during attachment of the closure with the end portion of the container, the sealing rib will be engaged by said end portion of the container so folding the second portion at least towards the inner surface of the first portion of the rib to form a seal between at least an outer surface of the end portion of the container and the closure, the closure being characterized in that there is an annular protrusion formed on the underside of the second portion and extending outwardly therefrom, the protrusion on attachment of the closure with the end portion engages the outer surface of the end portion so causing the sealing rib to be disposed over a greater area of the outer surface of the end portion of the container.

In a preferred embodiment, the annular protrusion comprises an annular ridge extending outwardly to a peak. The ridge is preferably substantially triangular in cross-section. One surface of the ridge preferably comprises an end portion engaging surface that acts to extend the area of the seal between the second portion and the container end portion on attachment of the closure to the container. The annular protrusion can be positioned about midway between the first portion and the circular edge of the second portion. In another embodiment, the annular protrusion can be positioned closer to the first position than the circular free edge of the second portion.

In one embodiment, the annular protrusion can have a resiliently flexible member extending outwardly from or adjacent the peak of the annular ridge. The flexible member, on attachment of the closure, engages the outer surface of the end portion and is flexed relative to the ridge. The flexing of the flexible member serves to provide further extension of the sealing area between the second portion and the outer surface on attachment of the closure. The resiliently flexible member preferably extends downwardly and inwardly from the peak of the annular protrusion prior to attachment of the closure to the container end portion. Further, the resiliently flexible member can taper in thickness as it extends away from the second portion of the sealing rib.

The end portion of the container to be sealed by the present invention preferably has a free end, an outer, preferably cylindrical, surface and an inner, preferably cylindrical, surface, the inner surface defining a bore. The join between the free end and the inner surface and the join between the free end and the outer surface are each preferably smoothly curved and define respectively what are hereinafter called the inner and outer sealing radii of the end portion of the container. Containers having end portions which do not have an inner and/or an outer sealing radii will, however, also be sealable by the closure defined herein.

The closure is preferably provided with a screw thread on an inside surface of the skirt portion adapted to engage with a corresponding thread on the outer surface of the end portion of the container. It is, however, possible for the container and the closure to be formed with other complementary attachment means. Such an arrangement could, for instance, comprise snap-on attachment means having a rib on the inside surface of the closure and a corresponding groove on the outer surface of the end portion of the container.

The inner surface of the first portion is preferably substantially cylindrical. The first portion of the rib can comprise a thickening of the skirt portion in the region adjacent the skirt's connection to the top portion. By comprising such a thickening, the root of the second portion of the rib is moved inwardly of the part of the skirt portion having the screw thread or other attachment means.

In another embodiment, the first portion of the sealing rib is formed radially inwardly of the skirt portion with an annular space therebetween. In a still further embodiment, the first portion of the sealing rib can be in abutment with the skirt portion.

In yet a further embodiment, the first portion of the rib can have a thickness that increases as it extends in a direction away from the top portion of the closure. This thickening of the first portion serves to increase the force of the pressure of the rib against the outer surface of the end portion of the container on attachment of the closure to the end portion. The thickness of the first portion can increase at a uniform rate along the length of the first portion away from the top portion, however, it could do so in a non-uniform manner. The increase in the thickness of the first portion means that the inner surface and, where there is one, the outer surface, of the first portion will each not necessarily be exactly cylindrical. They may respectively taper slightly inwardly and outwardly relative to the axis of the closure in a direction away from the top portion of the closure.

The inner surface of the first portion serves to form an abutment towards which the second portion is folded during attachment of the closure with the end portion of a container. Preferably, during attachment, the second portion will be folded back against the first portion such that it bears against the inner surface of the first portion. This will cause the second portion, including the annular protrusion, to bear more strongly against at least the outer surface of the end portion of the container and so form a better seal with at least the outer surface of the end portion.

In a further embodiment, the sealing rib can include a third portion connected to the second portion at or adjacent the circular edge of the second portion and extending generally in a direction away from the top portion. The third portion is preferably substantially no thicker than the second portion and further preferably has a length longer than its thickness. The third portion of the sealing rib is preferably contiguous with the circular edge of the second portion, though it may be spaced slightly radially outwardly from it. The third portion also preferably projects generally axially away from the top portion of the closure to its distal end. The third portion is preferably substantially cylindrical and can have both a cylindrical inner surface and a cylindrical outer surface. The third portion can join the second portion in an angular disjunction or it may join it in a smooth angular transition from the generally radially inward direction of the second portion to a generally axial direction. In this embodiment, on attachment of the closure to the end portion of the container, the third portion preferably seals with the end portion from a position on the outer surface of the end portion to at least the apex of the free end of the end portion.

The closure according to the present invention may be moulded from any suitable synthetic plastics material, however it is preferred that it is formed from a suitable grade of polyethylene or polypropylene. It is also preferred to form the closure in one piece. The closures could, however, be formed in two or more parts with at least the sealing rib formed separately from the top portion and the skirt portion.

It will be apparent to persons skilled in the art that numerous modifications may be made to the closure described in this specification without departing from the scope of the invention as earlier defined. The closure, for instance, is preferably provided with a tamper evident band adapted to provide an indication of removal or attempted removal of the closure from a container. The tamper evident band can extend from the skirt portion by connection through a plurality of frangible bridges. As the closure is removed from a container, the tamper evident band preferably provides an indication of this removal either before or as the second portion of the sealing rib disengages with at least the outer surface of the end portion of the container. This serves to ensure the integrity of the container's contents, that may have been filled by a hot fill or aseptic process, until ultimate consumption or use by the consumer of the container's contents.

As is described in Australian patent specifications 668197. the contents whereof are incorporated herein by reference, the band can also comprise a generally cylindrical body portion and a segmented rib extending inwardly of the body portion and adapted to provide a lip having an inner free edge to engage under a retaining flange extending outwardly from the end portion of the container. The combined length of the segmented ribs can be equal to at least 50% of the internal circumference of the band and the segmented ribs are preferably separated from each other by a gap. Each of the rib segments can each have an upper surface facing generally towards the top portion of the closure and an underside facing generally away from the top portion, with the inner surface of the band having a plurality of radially inward projections extending from above the free edge of the band and not extending beyond the inner free edge of the lip.

As is described in Australian patent specification 683598, the contents whereof are incorporated herein by reference, the upper surface of each rib segment extending inwardly of the body portion can comprise a first surface contiguous with the body portion of the band, which surface slopes inwardly and downwardly away from the top portion, and a second surface which extends radially inwardly from the inner terminus of the first surface and has a slope angle substantially normal to the skirt portion of the closure.

As is described in U.S. Pat. No. 5,676,269. the contents whereof are incorporated herein by reference, the tamper evident band can be joined to the skirt portion of the closure by a plurality of frangible bridges and at least one non-frangible bridge. The band can further have a substantially L-shaped slot extending through the side wall of he band, the horizontal leg of which terminates directly adjacent to or under the non-frangible bridge, and a weakened frangible region extending from the terminating end of the horizontal leg axially downwardly to the bottom of the band distal the frangible bridges.

The underside of the top portion of the closure can also have an engagement means comprising a continuous or segmented annular ridge radially inside of the sealing rib. The upper side of the second portion of the rib may also be formed with a complementary engagement means comprising a continuous or segmented annular ridge as is described in U.S. Pat. No. 5,782,369, the contents whereof are incorporated herein by reference. On attachment of the closure with the end portion, the complementary engagement means on the second portion engage with the underside of the top portion. Where the underside of the top portion has the engagement means, the respective engagement means preferably are adapted to interlock as the closure is attached to the container thereby holding the sealing rib touching the underside of the top portion stationary and causing the second portion of the sealing rib to be disposed over a still greater area of the underside of the top portion as well as the outer surface of the end portion.

Where the closure has a screw thread oil the inner surface of the skirt, the thread can be continuous or formed of a series of thread segments. If formed from a series of thread segments, the thread segments can be arranged, starting from a first thread segment distal to the top, along a helical thread locus, as is described in Australian patent specification 668197. Each of the thread segments except the first can be formed with two substantially planar end surfaces that are inclined to the axis of the closure and face away from the top of the closure, that is they face in the direction that a mould core used to mould the closure was withdrawn. In this specification, the term "substantially planar surface" is used to describe a surface that is nearly actually planar or that is curved provided that it all faces in the defined direction. The first of the thread segments is preferably pointed at its end distal to its one adjacent thread segment to assist in mating the thread on the closure with a complementary thread on the neck of a container.

The substantially planar ends of the thread segments can also be inclined to a notional radial plane of the closure extending from the longitudinal axis of the closure to the end of the respective thread segment such that the ends are inclined to the cylindrical skirt by an angle that is less than the angle that the respective notional plane makes with that skirt.

There also can be at the line of meeting of the first and second portions of the sealing rib, a weakened zone or annular region of weakness to assist even deformation of the second portion relative to the first as the closure is attached to a container as is described in Australian patent specification 637706, the contents whereof are incorporated herein by reference.

In a further aspect, the present invention comprises a mould for forming a closure as defined herein. The mould can be used to form the closure using injection or rotary moulding. It will be appreciated by persons skilled in the art that other suitable techniques for forming the closure could also be utilised.

In another aspect, the present invention comprises a container having an opening defined by an end portion of the container, the end portion being sealed by a closure as defined herein. The container can be used in an aseptic or hot fill process.

In a still further aspect, the present invention comprises a method of forming a closure as defined herein, the method comprising the step of moulding a synthetic plastics material in a mould.

The method can comprise the step of injection moulding the synthetic plastics materials in the mould.

In yet a further aspect, the present invention comprises a method of applying a closure as defined herein to an end portion of a container, the method comprising the step of turning the closure onto the end portion of the container until the closure seals the container.

BRIEF DESCRIPTION OF DRAWINGS

The following description of a preferred embodiment of the present invention is provided as an example of the invention and is described with reference to the accompanying drawings, in which.

BEST MODE FOR CARRYING OUT THE INVENTION

Figure 1:
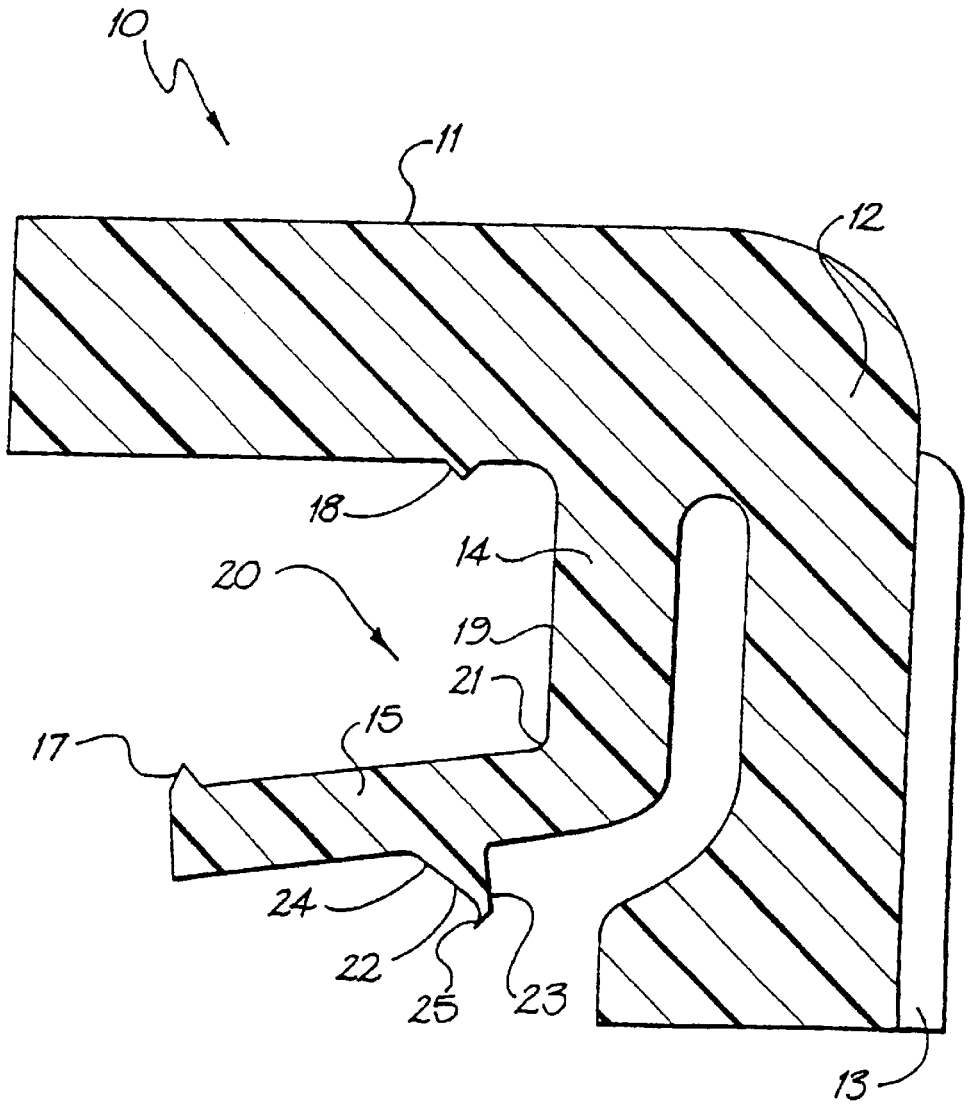
FIG. 1 is an enlarged sectional view of a portion of a closure according to the first aspect of the present invention before attachment with the end portion of a container.

A closure according to the present invention is generally depicted as 10 in the drawings.

The closure 10 comprises a circular top 11 and a depending skirt 12. The radially inner surface of the skirt 12 is provided with a segmented screw thread 35 that is adapted to mate with a corresponding continuous thread 36 on the neck of a bottle 16 to which the closure 10 is adapted to be attached. While the embodiment of the closure 10 depicted in the drawings has a screw thread 35, other suitable means for attaching the closure 10 to the bottle 16 would be immediately apparent to a person skilled in the art.

Figure 2:
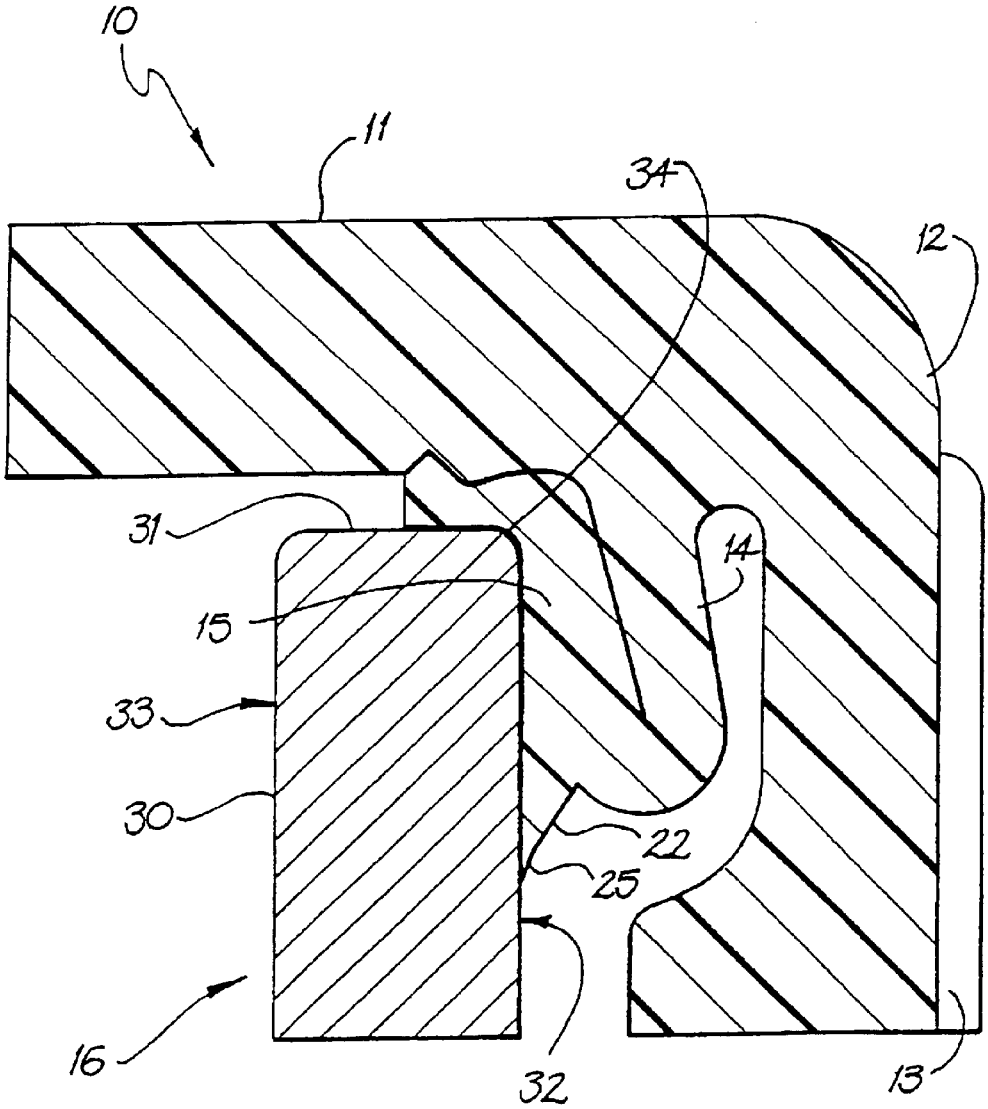
FIG. 2 is an enlarged sectional view of a portion of the closure of FIG. 1 sealingly engaged with the neck of a container.
Figure 3:
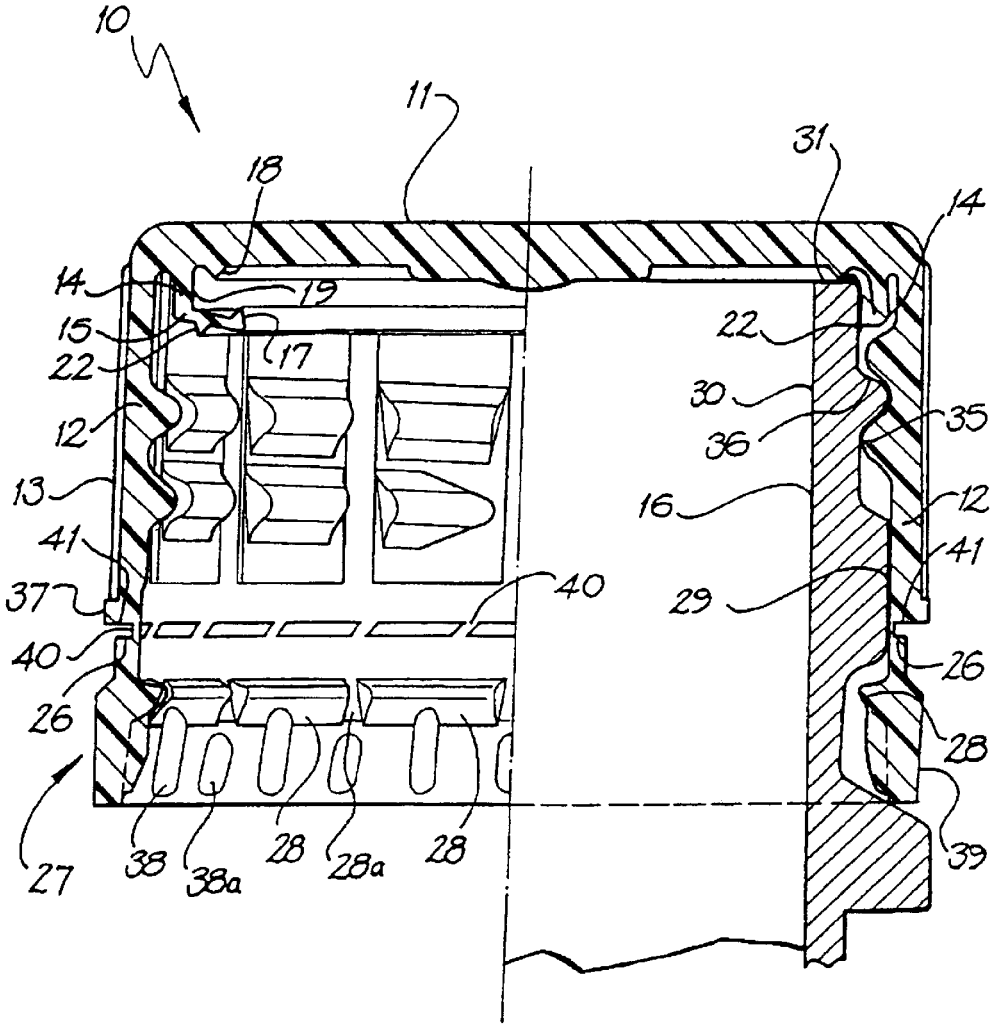
FIG. 3 is a part-diametrical view of an embodiment of the closure according to the present invention before engagement with the neck of a container and part-longitudinal cross-sectional view of the closure after sealing engagement with the neck of a container.

The bottle 16 can be fabricated from a plastics material such as polyethylene terephthalate (PET). The bottle is preferably adapted to be used in a hot fill or aseptic filling process. As depicted in FIGS. 2 and 3, the bottle 16 has an end portion 30 having a free end 31, an outer cylindrical surface 32, and a inner cylindrical surface 33. The join between the free end 31 and the outer surface 32 is smoothly curved and defines an outer sealing radius 34 for the end portion 30 of the bottle 16. Bottles having an end portion 30 which do not have an outer sealing radius will, however, still be sealable by the closure defined herein. The depicted closure 10 is formed integrally from high density polyethylene in a mould by injection moulding.

The radially outer surface of the skirt 12 carries a series of fine vertical ribs 13. The fine ribs 13 in the depicted embodiment terminate at the lower edge of the skirt 12 in a narrow circumferential rib 37.

A sealing rib 20 is provided on the underside of the top 11 of the closure 10. The rib 20 is continuous and annular. Seen in cross-section, the rib 20 has two main portions, a first portion 14 contiguous with the top 11 and spaced apart from the skirt 12 and a second portion 15. While depicted spaced from the skirt 12, the first portion 14 can, in another embodiment, comprise a thickening of the skirt 12 adjacent the top 11 or can abut the skirt 12. The inner surface 19 of the first portion 14 is substantially cylindrical, while the second portion 15, prior to attachment to the bottle 16, is frusto-conical in form. The second portion 15 is of substantially constant thickness as it extends radially inwardly from its outer edge which is contiguous with the lower end of the first portion 14. While depicted as being of substantially constant thickness, it will be envisaged that the second portion 15 can taper slightly in thickness as it extends radially inwardly from its outer edge. A relatively sharp edge 21 is formed between the first portion 14 and the second portion 15. This sharp edge 21 defines a line of weakness between the two portions for a purpose that will be described later in this specification.

The underside of the second portion 15 has an annular ridge 22 extending outwardly away from the top portion 11 to a peak 23. The ridge 22 is substantially triangular in cross-section, with one surface 24 being adapted to engage and so seal with the outer surface 32 of the end portion 30 of the bottle 16. The ridge 22 also has a tapering resiliently flexible member 25 that extends, prior to attachment of the closure 10 to the bottle 16, downwardly and inwardly from the peak 23 thereof. As is most clearly depicted in FIG. 2, the flexible member 25, on attachment of the closure 10, engages the outer surface 32 of the end portion 30 and is flexed relatively outwardly. This flexing of the flexible member 25 serves to provide further extension of the sealing area between the second portion 15 and the outer surface 32 on attachment of the closure 10 to the bottle 16.

The second portion 15 also has formed on its upper surface and proximate its free edge, a continuous annular ridge 17. The underside of the top 11 has formed on its surface inwardly of the first portion 14 a continuous annular ridge 18. As the closure is relatively turned on to the end portion 30 of the bottle 16, the second portion 15 contacts the free end 31 of the bottle 16 and is caused to fold up towards and, in this case, against the inner surface 19 of the first portion 14. As the closure 10 is further turned on to the bottle 16, contact is made between the underside of the top 11 and the ridge 17 and between the ridge 18 and the upper surface of the second portion 15.

Upon still further attachment of the closure 10, the ridge 17 abuts with the ridge 18 thereby ensuring the second portion 15 is wedged between the free end 31 of the bottle 16 and the underside of the top 11, ie, the movement attaching the closure 10 tends to pinch the second portion 15 of the rib 20 to pull the frusto-conical portion 15 tightly in towards the outer sealing radius 34 and the outer surface 32 of the end portion 30 to produce a tight seal that extends from the free end 31 around the outer sealing radius 34 and well down the outer surface 32 of the end portion 30 of the bottle 16.

The closure 10 has frangible bridges 40 extending between the lower edge 41 of the skirt 12 and the upper edge 26 of a tamper evident band 27 forming an annular weak zone. As the closure 10 moves relatively down the end portion of the bottle 16, the rib 28 on the interior surface of the band 27 diametrically expands over a retaining flange 29 on the bottle 16.

The axis of each frangible bridge 40 is inclined such that when seen in side elevation the upper end of each bridge 40 is inclined to the left relative to its lower end. The bridges 40, therefore, bend as the closure 10 is screwed clockwise onto the bottle 16. As the rib 28 expands over the flange 29, the lower edge 41 of the skirt 12 and the upper edge 26 of the band 27 have room to flex towards each other whilst still having the bridges 40 therebetween. This stabilises the band 27 and reduces the likelihood of the bridges 40 breaking during application of the closure 10 to the bottle 16. Once the rib 28 has passed over and engaged under the flange 29, the frangible bridges 40 return to their extended orientation.

The rib 28 is made up of a series of rib segments separated by short breaks 28*a*, however, the rib segments 28 constitute a majority of the circumference of the band 27 and act together as though the rib 28 was substantially continuous. The breaks 28*a* provide circumferential flexibility to the band 27 and allow the rib 28 to pass over the retaining flange 29 when the closure 10 is being applied to the bottle 16.

Below the rib 28 and on the inside surface of the band 27 is an arrangement of a plurality of inwardly extending projections 38 and 38*a*,each having a long axis generally aligned with the longitudinal axis of the closure 10. The projections 38 and 38*a* extend radially inwardly from the band 27 sufficiently so as to come into contact with the retaining flange 29 during application of the closure 10 to the bottle 16 and once the bottle 16 is capped to lie close to the outer surface of the end portion 30. Each alternate inwardly extending projection 38*a* is spaced below the break 28*a* in the rib 28 and is not connected to the rib 28. Each of the remaining extending projections 38 are connected at one end to the centre of a rib segment. Each inwardly extending projection 38 and 38*a* terminates short of the free end of the band 27. The projections 38 and 38*a* provide vertical strength to the band 27 while allowing radial expansion of the band 27 over the retaining flange 29.

On the outside surface of the band 27 there is provided a number of thickenings 39. Each thickening 39 extends from a region adjacent the level of rib 28 to a region at the free end of the band 27 and forms a corrugated surface on the outside surface of the band 27. The thickenings 39 strengthened the band 27 and thus enhance its vertical stiffness whilst retaining sufficient radial flexibility to allow the band 27 to radially expand over the retaining flange 29 when the closure 10 is being applied to the bottle 16. The thickenings 39 allow sufficient axial force to be applied to the free end of the closure 10 to successfully eject the closure 10 from a core portion of a mould used in its production.

The outer surfaces of the thickenings 39 present substantially flat lands which lie radially just outside the radial extent of the rest of the closure 10 to allow the land to be mechanically gripped or otherwise contacted without necessarily contacting the skirt 12.

As the closure 10 begins to be relatively unscrewed from the end portion 30, the rib 28 detains under the flange 29. As the closure 10 is unscrewed further, the bridges 40 are straightened which serves to concentrate the forces tending to rupture the bridges 40 at the point of attachment at each bridge 40 to the band 27 and the skirt 12.

The extension of the sealing area well down the outer surface 32 of the end portion 30 serves to delay the loss of seal between the closure 10 and the end portion 30 when the closure 10 is begun to be removed from the bottle 16. In the depicted embodiment, loss of seal does not occur until after or just as the bridges 40 connecting the tamper evident band 27 provide an indication of removal or attempted removal of the closure 10 from the bottle 16. This is particularly important in the case of containers that have been filled by a hot fill or aseptic process, where it is important that the consumer have confidence of seal integrity between the closure 10 and the bottle 16 up until the time that the closure 10 is actually removed from the bottle 16.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A closure suitable for mounting onto a container, the container having an opening defined by an end portion of the container, said end portion having a free end and an outer surface, the closure including:

a top portion;

a skirt portion depending from the top portion; and an annular sealing rib projecting downwardly from an underside of the top portion, the rib including:

a first portion which is contiguous with the top portion and has an inner surface, which inner surface lies radially inwardly of the skirt portion; and at least a second, frusto-conical, portion contiguous with the first portion and separated from the top portion by the inner surface of the first portion, the second portion having an upperside and an underside and extending radially inwardly to a circular edge, the underside of the second portion having an annular protrusion formed thereon at a location spaced outwardly from the circular edge and extending downwardly away from the top portion of the closure;

wherein the inner surface of the first portion has an internal diameter relative to the external diameter of the end portion of the container to which the closure is to be attached such that during attachment of the closure with the end portion of the container, the sealing rib will be engaged by said end portion of the container so folding the second portion at least towards the inner surface of the first portion of the rib to form a seal between at least the outer surface of the end portion of the container and at least a part of the second portion of the sealing rib between the free end thereof and the annular protrusion; and further wherein the spacing of the annular protrusion formed on the underside of the second portion from the circular edge thereof is such that during said attachment, the protrusion engages the outer surface at a position spaced from the container free end and the free end of the second portion engages the container free end.

2. The closure of claim 1 wherein the annular protrusion comprises an annular ridge extending outwardly to a peak.

3. The closure of claim 2 wherein the ridge is substantially triangular in cross-section.

4. The closure of claim 3 wherein one surface of the ridge comprises an end portion engaging surface that acts to extend the area of the seal between the second portion and the container end portion on attachment of the closure to the container.

5. The closure of claim 1 wherein the annular protrusion is positioned about midway between the first portion and the circular edge of the second portion.

6. The closure of claim 1 wherein the annular protrusion is positioned closer to the first position than the circular free edge of the second portion.

7. The closure of claim 1 wherein the annular protrusion has a resiliently flexible member extending outwardly from or adjacent a peak of the annular ridge, the resiliently flexible member serving to extend the area of the seal between the second portion and the container end portion on attachment of the closure to the container.

8. The closure of claim 7 wherein the resiliently flexible member extends downwardly and inwardly from the peak of the annular protrusion prior to attachment of the closure to the container end portion.

9. The closure of claim 7 wherein the resiliently flexible member tapers in thickness as it extends away from the second portion of the sealing rib.

10. The closure of claim 1 wherein a screw thread is provided on an inside surface of the skirt portion that is adapted to engage with a corresponding thread on the outer surface of the end portion of the container.

11. The closure of claim 1 wherein the first portion of the sealing rib is formed radially inwardly of the skirt portion with an annular space therebetween.

12. The closure of claim 1 wherein the inner surface of the first portion is substantially cylindrical.

13. The closure of claim 1 wherein the closure is made from polyethylene.

14. The closure of claim 1 wherein the closure is formed in one piece.

15. The closure of claim 1 wherein the closure has a tamper evident band adapted to provide an indication of removal or attempted removal of the closure from a container.

16. The closure of claim 15 wherein the tamper evident band extends from the skirt portion by connection through a plurality of frangible bridges.

17. The closure of claim 15 wherein as the closure is removed from a container, the tamper evident band provides an indication of this removal either before or as the second portion of the sealing rib disengages with at least the outer surface of the end portion of the container.

18. The closure of claim 1 wherein an underside of the top portion of the closure has an engagement means comprising a continuous or segmented annular ridge radially inside of the sealing rib.

19. The closure of claim 18 wherein the upper side of the second portion of the rib has a complementary engagement means comprising a continuous or segmented annular ridge and wherein, on attachment of the closure with the end, portion of the container the complementary engagement means are adapted to interlock thereby holding the sealing rib touching the underside of the top portion stationary and causing the second portion of the sealing rib to be disposed over a still greater area of the underside of the top portion as well as the outer surface of the end portion of the container.

20. The closure of claim 1 wherein at the line of meeting of the first and second portions of the sealing rib, a weakened zone or annular region of weakness is provided to assist even deformation of the second portion relative to the first portion as the closure is attach to the end portion of the container.

21. A container having an opening defined by an end portion of the container, the end portion being sealed by a closure according to claim 1.

22. The container of the claim 21 wherein the container is used in an aseptic or hot fill process.

23. A method of applying a closure as defined in claim 1 to an end portion of a container, the method comprising the step of turning the closure onto the end portion of a container until the closure seals the container.

* * * * *